US011839581B1

(12) United States Patent
Bei

(10) Patent No.: US 11,839,581 B1
(45) Date of Patent: Dec. 12, 2023

(54) VIBRATING FLAPPING MASSAGE MECHANISM

(71) Applicant: Liuqing Bei, Jieyang (CN)

(72) Inventor: Liuqing Bei, Jieyang (CN)

( * ) Notice: Subject to any disclaimer, the term of this patent is extended or adjusted under 35 U.S.C. 154(b) by 0 days.

(21) Appl. No.: 18/341,864

(22) Filed: Jun. 27, 2023

(30) Foreign Application Priority Data

Aug. 15, 2022 (CN) ..... 202222136651.6

(51) Int. Cl.
*A61H 15/00* (2006.01)
*A61H 23/00* (2006.01)

(52) U.S. Cl.
CPC . *A61H 15/0078* (2013.01); *A61H 2015/0071* (2013.01)

(58) Field of Classification Search
CPC ..... A61H 15/0078; A61H 2015/0071; A61H 7/007; A61H 23/00; A61H 23/006; A61H 23/02; A61H 23/0254; A61H 2201/0153; A61H 2201/0127; A61H 2201/12; A61H 2201/1207; A61H 2201/1215; A61H 2201/14; A61H 2201/1418; A61H 2201/1436; A61H 2201/1481; A61H 2201/149
See application file for complete search history.

(56) References Cited

U.S. PATENT DOCUMENTS 5,063,911 A * 11/1991 Teranishi ..... A61H 23/0254 D24/200
11,007,110 B1 * 5/2021 Zhou ..... A61H 23/0263
2003/0176817 A1 * 9/2003 Chang ..... A61H 23/02 601/9
2010/0063428 A1 * 3/2010 Wu ..... A61H 7/007 601/112

* cited by examiner

*Primary Examiner* — Quang D Thanh
(74) *Attorney, Agent, or Firm* — Daniel M. Cohn; Howard M. Cohn

(57) ABSTRACT

A vibrating flapping massage mechanism includes a cup-shaped housing, a motor arranged in the cup-shaped housing, and eccentric wheels fixedly connected to a motor rotating shaft of the motor. The eccentric wheels include eccentric wheel horizontal shafts connected to at least one push-pull piece. An air cushion soft rubber piece is arranged on the at least one push-pull piece. A curved concave cavity is defined on the air cushion soft rubber piece. A soft rubber convex cavity is defined on the curved concave cavity. A bottom portion of the soft rubber convex cavity is embedded and bonded with the top portion of the at least one push-pull piece. At least one push-pull piece circular hole soft rubber piece is arranged on the at least one push-pull pieces. The at least one push-pull piece circular hole soft rubber piece is sleeved on a corresponding eccentric wheel horizontal shaft.

8 Claims, 4 Drawing Sheets

VIBRATING FLAPPING MASSAGE MECHANISM

TECHNICAL FIELD

The present disclosure relates to a technical field of health care massage products, in particular to a vibrating flapping massage mechanism.

BACKGROUND

With rapid development of science and technology, electronic products are more and more widely used, and standards for the electronic products are higher and higher. There are various massage products on the market, such as large massage beds, massage chairs, foot massage tubs, small cervical spine massage clips, back massage sticks, facial massage instruments, etc., which bring different degrees of enjoyment to people's body and organs. However, the above-mentioned massage products either have a single function, or require multiple motors to work to realize a multi-functional massage effect, so the massage products have many limitations. For example, if a massage product needs to provide functions of vibration and flapping at the same time, the number of the motors needs to be increased, leading to increased production costs, and consuming more labor and resources.

There is a kind of air compression massager on the market, which repeatedly flaps a massage part of the human body to generate a flapping massage effect.

However, the air compression massager still has following disadvantages:

1. The flapping effect of the air compression massager on the massage part is very small, and a massage effect is poor: The air compression massager lowers or increases air pressure in a cavity thereof by reciprocally pulling a silicone piece up and down, thus forming a blowing effect or the flapping effect on the massage part. The flapping effect is realized by air instead of a physical flapping piece. In actual use, a user only feels a blowing sensation and hardly feels a slapping sensation. As a result, the flapping effect is not realized. Moreover, the air compression massager does not have a vibration effect and a function thereof is single.
2. A motor of the air compression massager only drives a massage mechanism and is unable to realize multi-point simultaneous massage.

SUMMARY

In order to solve above technical problems, the present disclosure provides a vibrating and flapping massage mechanism. The vibrating and flapping massage mechanism vibrates and flaps a massaged part through at least one air cushion, thus having a strong vibration effect and a good flapping effect. Cushioning of the at least one air cushion not only increases comfort but also avoids damage to the human body caused by excessive force. The vibrating and flapping massage mechanism has a vibration massage effect while having a flapping effect. The vibrating flapping massage mechanism has a simple structure, strong stability, long service life, and high assembly efficiency, and is a multi-point massage mechanism.

The vibrating flapping massage mechanism comprises a cup-shaped housing, a motor arranged in the cup-shaped housing, and eccentric wheels fixedly connected to a motor rotating shaft of the motor. The eccentric wheels comprises eccentric wheel horizontal shafts. Each of the eccentric wheel horizontal shafts is arranged on an outer side of each of the eccentric wheels. The eccentric wheel horizontal shafts are connected to at least one push-pull piece. An air cushion soft rubber piece is arranged on a top portion of the at least one push-pull piece.

A curved concave cavity is defined on a top portion of the air cushion soft rubber piece. A soft rubber convex cavity protruding upward is defined on a central portion of the curved concave cavity. An inner side of a bottom portion of the soft rubber convex cavity is embedded and bonded with the top portion of the at least one push-pull piece.

At least one push-pull piece circular hole soft rubber piece is arranged on a bottom portion of the at least one push-pull piece. The at least one push-pull piece circular hole soft rubber piece is sleeved on a corresponding eccentric wheel horizontal shaft. Each of the eccentric wheels defines an eccentric hole. Each eccentric hole is fixedly connected to the motor rotating shaft. A position of the eccentric hole on each of the eccentric wheels is symmetrical to a position of a corresponding eccentric wheel horizontal shaft by taking a center point of each of the eccentric wheels as a midpoint.

The motor rotating shaft drives the eccentric wheels to perform eccentric rotation to vibrate when the motor rotating shaft works. Each of the eccentric wheel horizontal shafts drives the at least one push-pull piece circular hole soft rubber piece to perform centrifugal rotation by taking the motor rotating shaft as a center, so as to reciprocate the at least one push-pull piece to push up and pull down. The at last one push-pull piece is driven to push upwards when the at least one push-pull piece circular hole soft rubber piece rotates upwards, and a bottom portion of the air cushion soft rubber piece and the soft rubber convex cavity are jacked up. The at least one push-pull piece is driven to pull downwards when the at least one push-pull piece circular hole soft rubber piece rotates downwards, and the bottom portion of the air cushion soft rubber piece and the soft rubber convex cavity are pulled downwards, so that the soft rubber convex cavity is repeatedly jacked up and pulled downwards to forms a flapping action.

When two or more push-pull pieces are provided, the top portion of each push-pull piece is fixedly connected to a corresponding air cushion soft rubber piece.

Each push-pull piece faces the corresponding air cushion soft rubber piece. An orientation of each air cushion soft rubber piece is adjustable.

When only one push-pull piece is provide, there are two eccentric wheels. A first eccentric wheel is fixedly connected to a left end of the motor rotating shaft of the motor. A second eccentric wheel is fixedly connected to a right end of the motor rotating shaft of the motor. A distance of the first eccentric wheel to the motor is equal to a distance of the second eccentric wheel to the motor. The push-pull piece is bridged on the two eccentric wheels. Two push-pull piece circular hole soft rubber pieces are arranged at the bottom portion of the push-pull piece. Each of the push-pull piece circular hole soft rubber pieces is rotatable and is sleeved on a corresponding eccentric wheel horizontal shaft.

When two or more push-pull pieces are provided, the number of the eccentric wheels is same as the number of the push-pull pieces. Each push-pull piece is connected to a corresponding eccentric wheel. The eccentric wheels are respectively fixedly connected to a left end and a right end of the motor rotating shaft of the motor. Each push-pull piece is cylindrical. The bottom portion of each push-pull piece is connected to a corresponding push-pull piece circular hole soft rubber piece. Each push-pull piece circular hole soft rubber piece is rotatable and is sleeved on the corresponding eccentric wheel horizontal shaft.

An outer edge of the top portion of the air cushion soft rubber piece is embedded and fixed on an inner side of an edge of a top opening of the cup-shaped housing.

The motor is connected to a switch circuit board in series through a motor wire. The switch circuit board is connected to a battery in series through a battery wire. The switch circuit board is connected to a charging component in series through a charging wire. The switch circuit board controls the motor to work.

A hard rubber inner housing is arranged on an inner side of the cup-shaped housing. The hard rubber inner housing defines a cavity. The motor, the eccentric wheels, the at least one push-pull piece, the air cushion soft rubber piece, the switch circuit board, the battery wire, the battery, the motor wire, the charging component, and the charging wire are arranged in the cavity of the hard rubber inner housing. The curved concave cavity defined on the top portion of the air cushion soft rubber piece is exposed out of the hard rubber inner housing. The hard rubber inner housing comprises an inner housing upper cover and an inner housing lower cover. The outer edge of the top portion of the air cushion soft rubber piece is bonded and fixed at a top opening of the inner housing lower cover and a top opening of the inner housing upper cover.

The eccentric wheels centrifugally rotate to generate vibration effect. When the switch circuit board is turned on and energized, the motor starts to work, and the top portion of the at least one push-pull piece reciprocates against the bottom portion of the corresponding air cushion soft rubber piece. Since the soft rubber convex cavity protruding upward and sealed is defined on the central portion of the corresponding air cushion soft rubber piece, when the bottom portion of each air cushion soft rubber piece is repeatedly impacted, each soft rubber convex cavity is deformed and generates reciprocating elastic force. That is, an upward thrust from the at least one push-pull piece is transmitted, making an outer wall of the soft rubber convex cavity generate an upward thrust, and the pull force of the at least one push-pull piece causes the outer wall of the corresponding soft rubber convex cavity to generate a downward pull force. Therefore, the outer wall of the soft rubber convex cavity repeatedly flaps the human body.

By defining the soft rubber convex cavity in the central portion of each air cushion soft rubber piece, when in use, the outer wall of each soft rubber convex cavity repeatedly flaps on the human body, the flapping effect is obvious, the massage effect is good, the comfort is good, and cushioning of each air cushion soft rubber piece avoids damage to the human body.

In the present disclosure, the eccentric wheels are directly and fixedly connected to the motor rotating shaft, and each of the eccentric wheel horizontal shafts is arranged on the outer side of each of the eccentric wheels. The eccentric wheel horizontal shafts are connected to the at least one push-pull piece. The at least one push-pull piece circular hole soft rubber piece arranged on the bottom portion of the at least one push-pull piece is rotatable and is sleeved on the corresponding eccentric wheel. The eccentric wheels rotate to generates a strong centrifugal vibration effect and have a push-pull function. A structure of the eccentric wheels is simple, and the eccentric wheels do not jam nor stagnate, therefore, service life of the vibrating flapping massage mechanism is prolonged.

In the present disclosure, the vibrating flapping massage mechanism has the simple structure and the high assembly efficiency.

In the present disclosure, when there are two or more air cushion soft rubber pieces, the orientation of each air cushion soft rubber is determined according to actual needs and is able to be applied to products with different shapes. The motor realizes multi-point and multi-directional vibration and flapping functions.

In the present disclosure, the cup-shaped housing is arranged on the outermost of the vibrating flapping massage mechanism. When using the vibrating flapping massage mechanism, the user is able to hold a bottom portion of the cup-shaped housing and place an opening on a top portion of the cup-shaped housing on a position to be massaged, which is convenient to hold and use.

1. motor; 2. motor rotating shaft 3. eccentric wheel; 3-1. eccentric wheel horizontal shaft; 4. push-pull piece; 4-1. push-pull piece circular hole soft rubber piece; 5. air cushion soft rubber piece; 6. curved concave cavity; 7. soft rubber convex cavity; 8. switch circuit board; 8-1. battery wire; 9. battery; 9-1. motor wire; 10. charging component; 10-1. charging wire; 11. cup-shaped housing; 12. hard rubber inner housing 13. inner housing upper cover; 14. inner housing lower cover.

DETAILED DESCRIPTION

Figure 1:
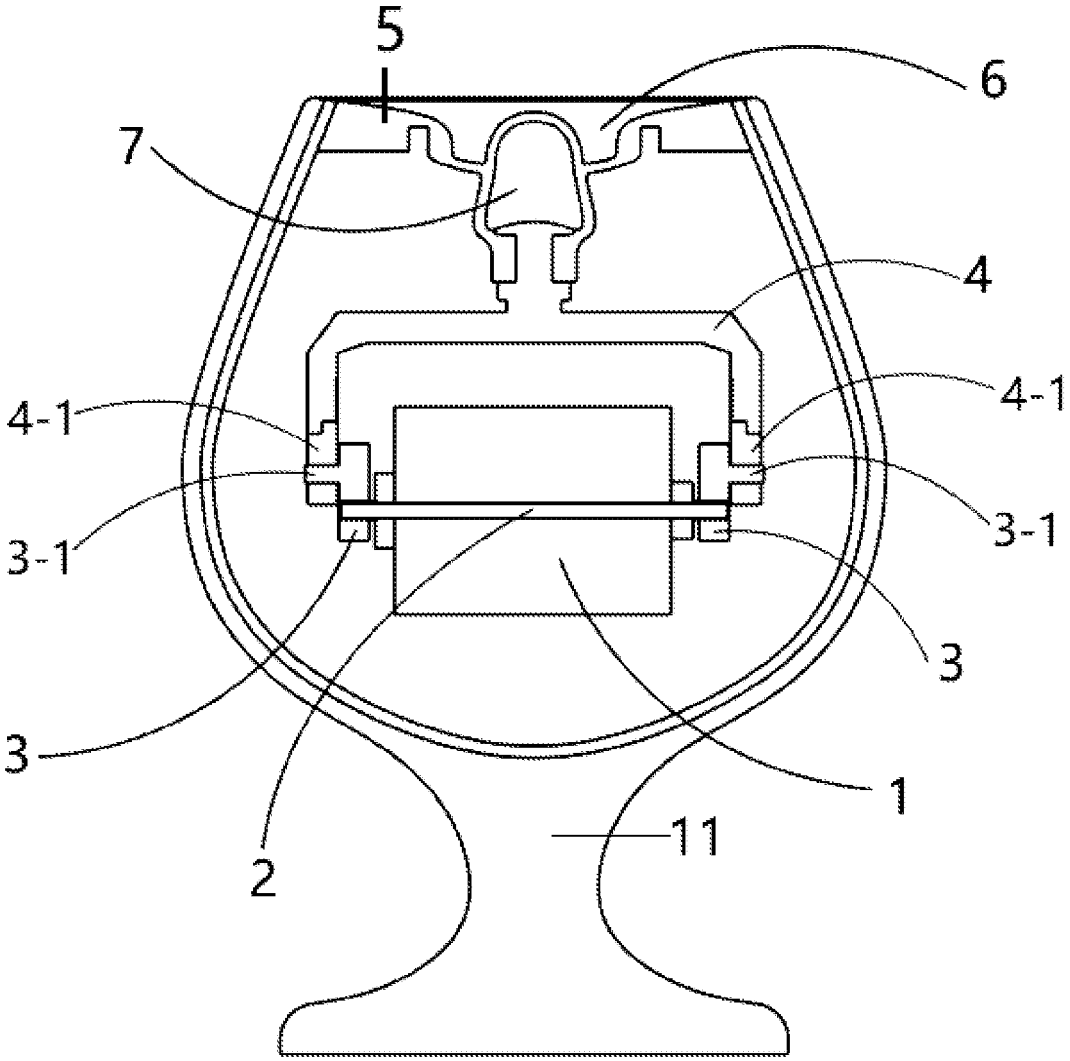
FIG. 1 is a front side cross-sectional schematic diagram of a vibrating flapping massage mechanism including only one push-pull piece of the present disclosure.
Figure 2:
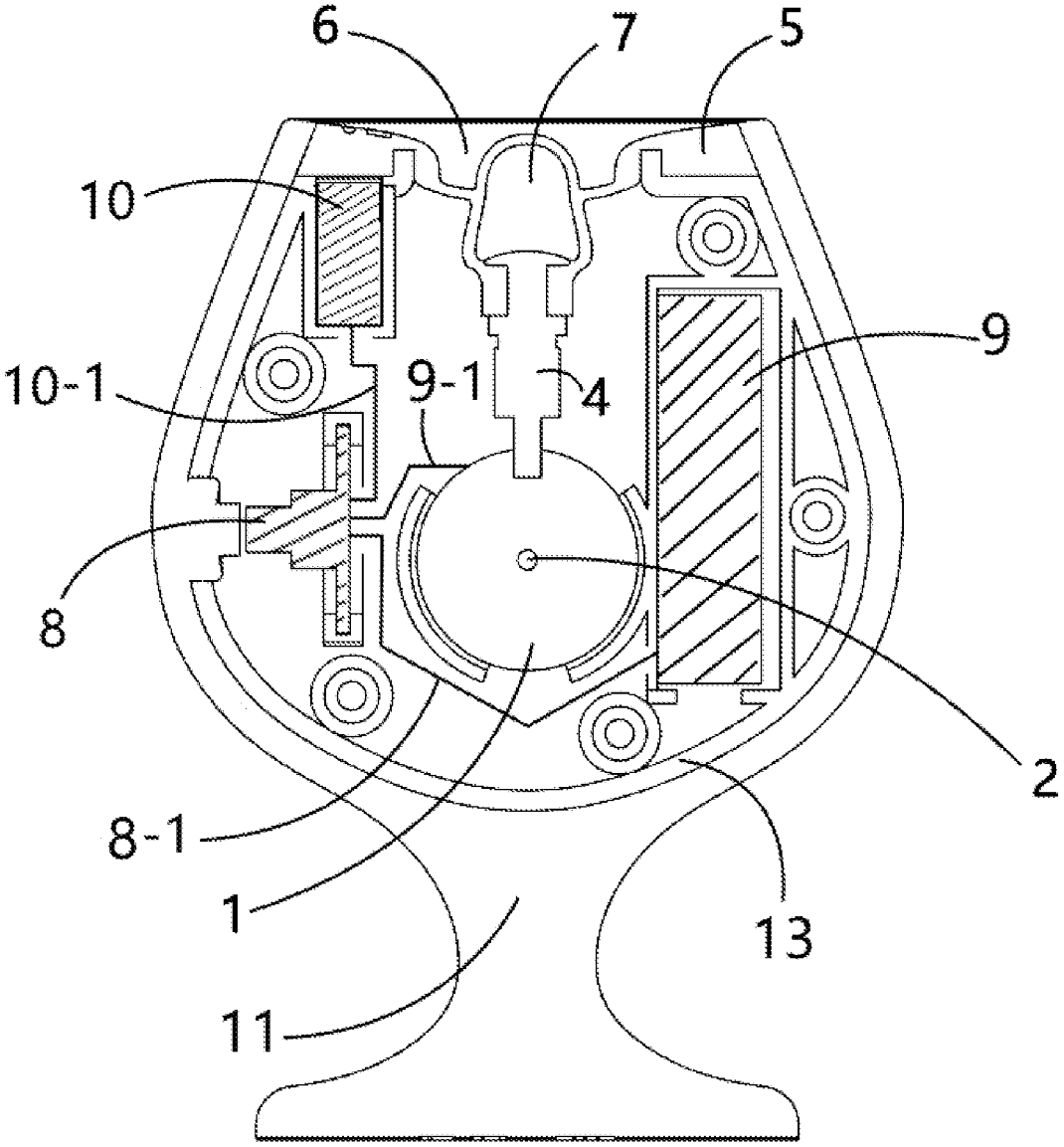
FIG. 2 is a side cross-sectional schematic diagram of the vibrating flapping massage mechanism including only one push-pull piece of the present disclosure.
Figure 3:
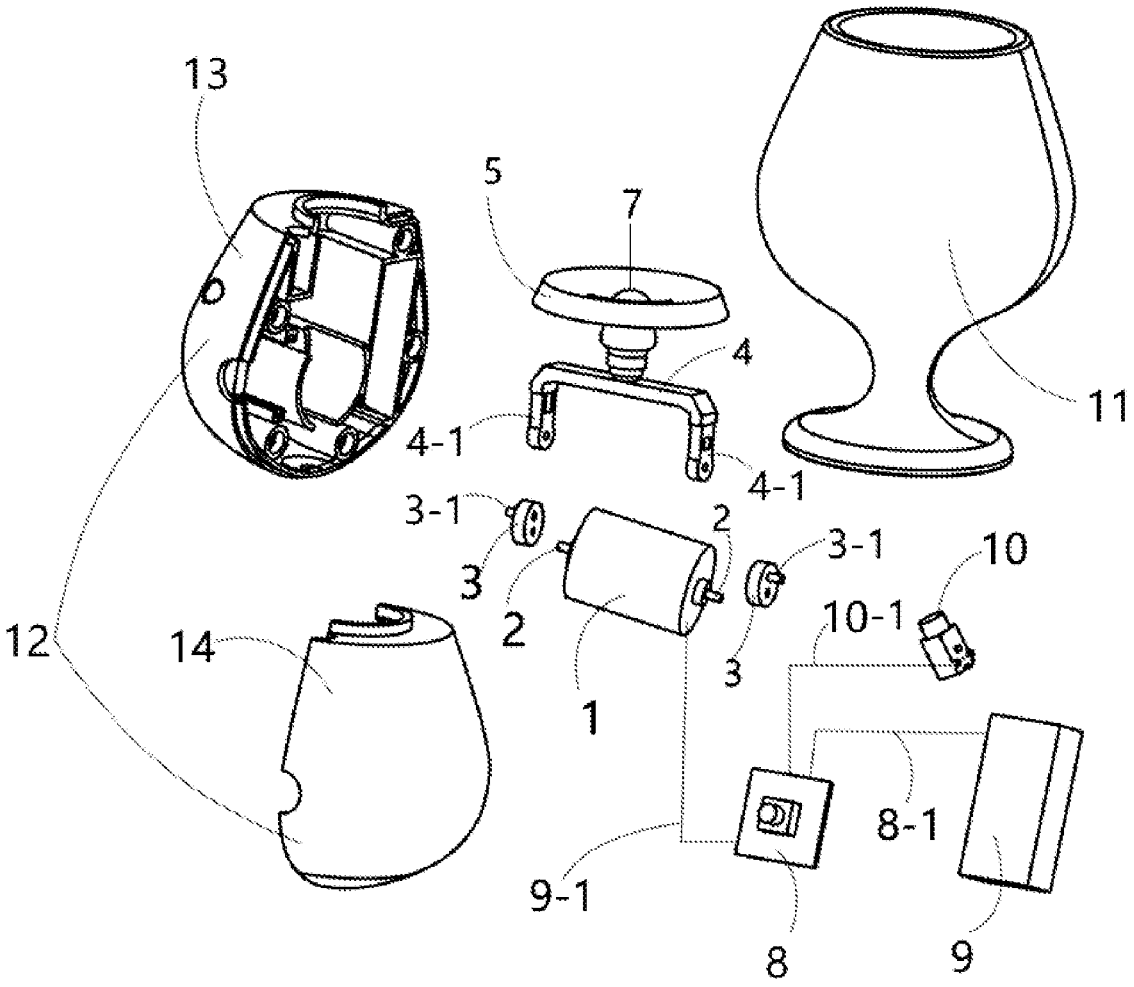
FIG. 3 is an exploded schematic diagram of the vibrating flapping massage mechanism including only one push-pull piece of the present disclosure.
Figure 4:
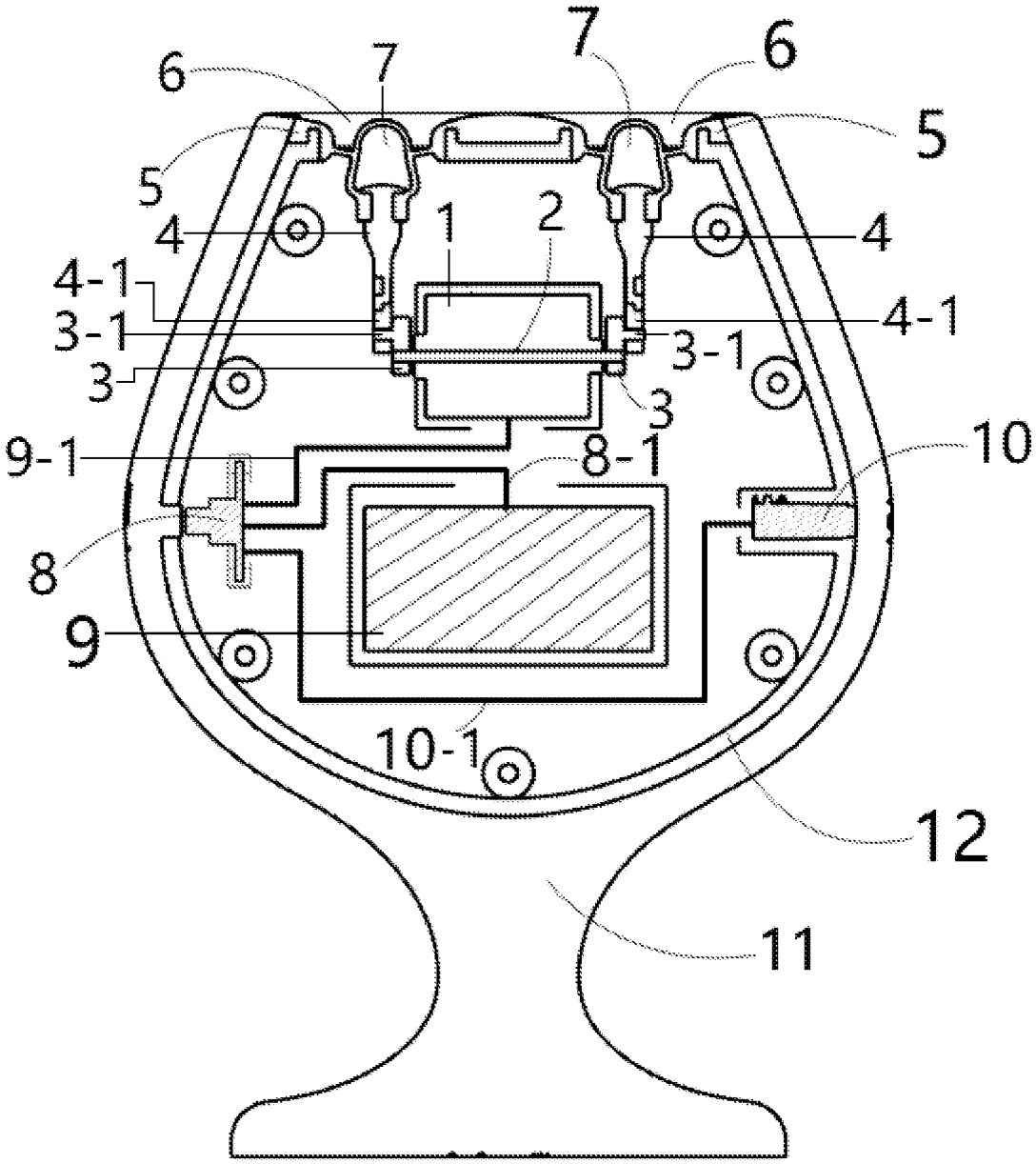
FIG. 4 is a cross-sectional schematic diagram of the vibrating flapping massage mechanism including two push-pull pieces of the present disclosure.

As shown in FIGS. 1-4, the present disclosure provides a vibrating flapping massage mechanism. The vibrating flapping massage mechanism comprises a cup-shaped housing 11, a motor 1 arranged in the cup-shaped housing 11, and eccentric wheels 3 fixedly connected to a motor rotating shaft 2 of the motor 1. The eccentric wheels 3 comprises eccentric wheel horizontal shafts 3-1. Each of the eccentric wheel horizontal shafts 3-1 is arranged on an outer side of each of the eccentric wheels 3. The eccentric wheel horizontal shafts 3-1 are connected to at least one push-pull piece 4. An air cushion soft rubber piece 5 is arranged on a top portion of the at least one push-pull piece 4.

A curved concave cavity 6 is defined on a top portion of the air cushion soft rubber piece 5. A soft rubber convex cavity 7 protruding upward is defined on a central portion of the curved concave cavity 6. An inner side of a bottom portion of the soft rubber convex cavity 7 is embedded and bonded with the top portion of the at least one push-pull piece 4.

At least one push-pull piece circular hole soft rubber piece 4-1 is arranged on a bottom portion of the at least one push-pull piece 4. The at least one push-pull piece circular hole soft rubber piece 4-1 is sleeved on a corresponding eccentric wheel horizontal shaft 3-1. Each of the eccentric wheels 3 defines an eccentric hole. Each eccentric hole is fixedly connected to the motor rotating shaft 2. A position of the eccentric hole on each of the eccentric wheels 3 is symmetrical to a position of a corresponding eccentric wheel horizontal shaft 3-1 by taking a center point of each of the eccentric wheels 3 as a midpoint.

The motor rotating shaft 2 drives the eccentric wheels 3 to perform eccentric rotation to vibrate when the motor rotating shaft 2 works. Each of the eccentric wheel horizontal shafts 3-1 drives the at least one push-pull piece circular hole soft rubber piece 4-1 to perform centrifugal rotation by taking the motor rotating shaft 2 as a center, so as to reciprocate the at least one push-pull piece 4 to push up and pull down. The at last one push-pull piece 4 is driven to push upwards when the at least one push-pull piece circular hole soft rubber piece 4-1 rotates upwards, and a bottom portion of the air cushion soft rubber piece 5 and the soft rubber convex cavity 7 are jacked up. The at least one push-pull piece 4 is driven to pull downwards when the at least one push-pull piece circular hole soft rubber piece 4-1 rotates downwards, and the bottom portion of the air cushion soft rubber piece 5 and the soft rubber convex cavity 7 are pulled downwards, so that the soft rubber convex cavity 7 is repeatedly jacked up and pulled downwards to forms a flapping action.

When two or more push-pull pieces 4 are provided, the top portion of each push-pull piece 4 is fixedly connected to a corresponding air cushion soft rubber piece 5.

Each push-pull piece 4 faces the corresponding air cushion soft rubber piece 5. An orientation of each air cushion soft rubber piece 5 is adjustable according to actual use.

When only one push-pull piece 4 is provide, there are two eccentric wheels 3. A first eccentric wheel 3 is fixedly connected to a left end of the motor rotating shaft 2 of the motor 1. A second eccentric wheel 3 is fixedly connected to a right end of the motor rotating shaft 2 of the motor 2. A distance of the first eccentric wheel 3 to the motor 1 is equal to a distance of the second eccentric wheel 3 to the motor 2. The push-pull piece 4 is bridged on the two eccentric wheels 3. Two push-pull piece circular hole soft rubber pieces 4-1 are arranged at the bottom portion of the push-pull piece 4. Each of the push-pull piece circular hole soft rubber pieces 4-1 is rotatable and is sleeved on a corresponding eccentric wheel horizontal shaft 3-1.

When two or more push-pull pieces 4 are provided, the number of the eccentric wheels 3 is same as the number of the push-pull pieces 4. Each push-pull piece 4 is connected to a corresponding eccentric wheel 3. The eccentric wheels 3 are respectively fixedly connected to a left end and a right end of the motor rotating shaft 2 of the motor 1. Each push-pull piece 4 is cylindrical. The bottom portion of each push-pull piece 4 is connected to a corresponding push-pull piece circular hole soft rubber piece 4-1. Each push-pull piece circular hole soft rubber piece 4-1 is rotatable and is sleeved on the corresponding eccentric wheel horizontal shaft 3-1.

An outer edge of the top portion of each air cushion soft rubber piece 5 is embedded and fixed on an inner side of an edge of a top opening of the cup-shaped housing 11.

The motor 1 is connected to a switch circuit board 8 in series through a motor wire 9-1. The switch circuit board 8 is connected to a battery 9 in series through a battery wire 8-1. The switch circuit board 8 is connected to a charging component 10 in series through a charging wire 10-1. The switch circuit board 8 controls the motor 1 to work.

A hard rubber inner housing 12 is arranged on an inner side of the cup-shaped housing 11. The hard rubber inner housing 12 defines a cavity. The motor 1, the eccentric wheels 3, each push-pull piece 4, each air cushion soft rubber piece 5, the switch circuit board 8, the battery wire 8-1, the battery 9, the motor wire 9-1, the charging component 10, and the charging wire 10-1 are arranged in the cavity of the hard rubber inner housing 12. The curved concave cavity 6 defined on the top portion of each air cushion soft rubber piece 5 is exposed out of the hard rubber inner housing 12. The hard rubber inner housing 12 comprises an inner housing upper cover 13 and an inner housing lower cover 14. The outer edge of the top portion of each air cushion soft rubber piece 5 is bonded and fixed at a top opening of the inner housing lower cover 14 and a top opening of the inner housing upper cover 13.

The eccentric wheels 3 centrifugally rotate to generate vibration effect. When the vibrating flapping massage mechanism is powered, each push-pull piece 4 reciprocates against the bottom portion of the corresponding air cushion soft rubber piece 5. Since the soft rubber convex cavity 7 protruding upward and sealed is defined on the central portion of the corresponding air cushion soft rubber piece 5, when the bottom portion of the corresponding air cushion soft rubber piece 5 is repeatedly impacted, each soft rubber convex cavity 7 is deformed and generates reciprocating elastic force. That is, an upward thrust from the at least one push-pull piece 4 is transmitted, making an outer wall of a corresponding soft rubber convex cavity 7 generate an upward thrust, and the pull force of the at least one push-pull piece 4 causes the outer wall of the corresponding soft rubber convex cavity 7 to generate a downward pull force. Therefore, the outer wall of the corresponding soft rubber convex cavity repeatedly flaps the human body. Therefore, the vibrating flapping massage mechanism has a flapping effect and a vibration massage effect.

Foregoing descriptions are only optional embodiments of the present disclosure and are not intended to limit the present disclosure. Any modification, equivalent replacement, or improvement within the technical scope of the present disclosure should be included in the protection scope of the present disclosure.

What is claimed is:

1. A vibrating flapping massage mechanism, comprising:

a cup-shaped housing (11), a motor (1) arranged in the cup-shaped housing (11), and eccentric wheels (3) fixedly connected to a motor rotating shaft (2) of the motor (1);

wherein the eccentric wheels (3) comprises eccentric wheel horizontal shafts (3-1); each of the eccentric wheel horizontal shafts (3-1) is arranged on an outer side of each of the eccentric wheels (3); the eccentric wheel horizontal shafts (3-1) are connected to at least one push-pull piece (4); an air cushion soft rubber piece (5) is arranged on a top portion of the at least one push-pull piece (4);

wherein a curved concave cavity is defined on a top portion of the air cushion soft rubber piece (5); a soft rubber convex cavity (7) protruding upward is defined on a central portion of the curved concave cavity (6); an inner side of a bottom portion of the soft rubber convex cavity (7) is embedded and bonded with the top portion of the at least one push-pull piece (4);

wherein at least one push-pull piece circular hole soft rubber piece (4-1) is arranged on a bottom portion of the at least one push-pull piece (4); the at least one push-pull piece circular hole soft rubber piece (4-1) is sleeved on a corresponding eccentric wheel horizontal shaft (3-1); each of the eccentric wheels (3) defines an eccentric hole; each eccentric hole is fixedly connected to the motor rotating shaft (2); a position of the eccentric hole on each of the eccentric wheels (3) is symmetrical to a position of a corresponding eccentric wheel horizontal shaft (3-1) by taking a center point of each of the eccentric wheels (3) as a midpoint;

wherein the motor rotating shaft (2) drives the eccentric wheels (3) to perform eccentric rotation to vibrate when the motor rotating shaft (2) works; each of the eccentric wheel horizontal shafts (3-1) drives the at least one push-pull piece circular hole soft rubber piece (4-1) to perform centrifugal rotation by taking the motor rotating shaft (2) as a center, so as to reciprocate the at least one push-pull piece (4) to push up and pull down; the at last one push-pull piece (4) is driven to push upwards when the at least one push-pull piece circular hole soft rubber piece (4-1) rotates upwards, and a bottom portion of the air cushion soft rubber piece (5) and the soft rubber convex cavity (7) are jacked up; the at least one push-pull piece (4) is driven to pull downwards when the at least one push-pull piece circular hole soft rubber piece (4-1) rotates downwards, and the bottom portion of the air cushion soft rubber piece (5) and the soft rubber convex cavity (7) are pulled downwards, so that the soft rubber convex cavity (7) is repeatedly jacked up and pulled downwards to forms a flapping action.

2. The vibrating flapping massage mechanism according to claim 1, wherein when two or more push-pull pieces (4) are provided, the top portion of each push-pull piece (4) is fixedly connected to a corresponding air cushion soft rubber piece (5).

3. The vibrating flapping massage mechanism according to claim 2, wherein each push-pull piece(4) faces the corresponding air cushion soft rubber piece (5); an orientation of each air cushion soft rubber piece (5) is adjustable.

4. The vibrating flapping massage mechanism according to claim 1, wherein when only one push-pull piece (4) is provide, there are two eccentric wheels (3); a first eccentric wheel (3) is fixedly connected to a left end of the motor rotating shaft (2) of the motor (1); a second eccentric wheel (3) is fixedly connected to a right end of the motor rotating shaft (2) of the motor (1); a distance of the first eccentric wheel (3) to the motor (1) is equal to a distance of the second eccentric wheel (3) to the motor (1); the one push-pull piece (4) is bridged on the two eccentric wheels (3); two push-pull piece circular hole soft rubber pieces (4-1) are arranged at the bottom portion of the one push-pull piece (4); each of the push-pull piece circular hole soft rubber pieces is rotatable and is sleeved on a corresponding eccentric wheel horizontal shaft (3-1).

5. The vibrating flapping massage mechanism according to claim 1, wherein when two or more push-pull pieces (4) are provided, a number of the eccentric wheels (3) is same as a number of the push-pull pieces(4); each push-pull piece (4) is connected to a corresponding eccentric wheel (3); the eccentric wheels (3) are respectively fixedly connected to a left end and a right end of the motor rotating shaft (2) of the motor (1); each push-pull piece (4) is cylindrical; the bottom portion of each push-pull piece (4) is connected to a corresponding push-pull piece circular hole soft rubber piece (4-1); each push-pull piece circular hole soft rubber piece is rotatable and is sleeved on a corresponding eccentric wheel horizontal shaft (3-1).

6. The vibrating flapping massage mechanism according to claim 1, wherein an outer edge of the top portion of the air cushion soft rubber piece (5) is embedded and fixed on an inner side of an edge of a top opening of the cup-shaped housing (11).

7. The vibrating flapping massage mechanism according to claim 6, wherein the motor (1) is connected to a switch circuit board (8) in series through a motor wire (9-1); the switch circuit board (8) is connected to a battery (9) in series through a battery wire (8-1); the switch circuit board (8) is connected to a charging component (10) in series through a charging wire (10-1); the switch circuit board (8) controls the motor (1) to work.

8. The vibrating flapping massage mechanism according to claim 7, wherein a hard rubber inner housing (12) is arranged on an inner side of the cup-shaped housing (11); the hard rubber inner housing (12) defines a cavity; the motor (1), the eccentric wheels (3), the at least one push-pull piece (4), the air cushion soft rubber piece (5), the switch circuit board (8), the battery wire (8-1), the battery (9), the motor wire (9-1), the charging component (10), and the charging wire (10-1) are arranged in the cavity of the hard rubber inner housing (12); the curved concave cavity (6) defined on the top portion of the air cushion soft rubber piece (5) is exposed out of the hard rubber inner housing (12); the hard rubber inner housing (12) comprises an inner housing upper cover (13) and an inner housing lower cover (14); the outer edge of the top portion of the air cushion soft rubber piece (5) is bonded and fixed at a top opening of the inner housing lower cover (14) and a top opening of the inner housing upper cover (13).

* * * * *